US008763520B1

(12) United States Patent
Sanita

(10) Patent No.: US 8,763,520 B1
(45) Date of Patent: Jul. 1, 2014

(54) PYRAMID PAN

(76) Inventor: Richard Jason Sanita, Reading, PA (US)

( * ) Notice: Subject to any disclaimer, the term of this patent is extended or adjusted under 35 U.S.C. 154(b) by 14 days.

(21) Appl. No.: 12/068,129

(22) Filed: Feb. 4, 2008

(51) Int. Cl.
*A47J 37/10* (2006.01)
*A47J 37/07* (2006.01)

(52) U.S. Cl.
USPC ..... 99/422; 99/447

(58) Field of Classification Search
USPC ..... 99/422, 393, 402, 444, 445, 447, 448
See application file for complete search history.

(56) References Cited

U.S. PATENT DOCUMENTS

| | | | | | |
|---|---|---|---|---|---|
| 75,673 | A * | 3/1868 | Gibson | 99/425 |
| 1,707,532 | A * | 4/1929 | Moon | 99/339 |
| 2,008,767 | A * | 7/1935 | Munn | 99/425 |
| 2,066,507 | A * | 1/1937 | Yost | 99/376 |
| 2,618,258 | A * | 11/1952 | Kroyer | 126/390.1 |
| 3,113,505 | A * | 12/1963 | Keppler | 99/425 |
| 3,958,504 | A * | 5/1976 | Levin | 99/426 |
| 4,121,510 | A * | 10/1978 | Frederick | 99/425 |
| 4,885,989 | A * | 12/1989 | Korpan | 99/450 |
| 5,009,151 | A * | 4/1991 | Hungerford | 99/445 |
| 5,921,173 | A * | 7/1999 | Grycan et al. | 99/422 |
| 2003/0157343 | A1 * | 8/2003 | Yeung | 428/447 |
| 2005/0193899 | A1 * | 9/2005 | DeBlassie et al. | 99/426 |
| 2006/0266757 | A1 * | 11/2006 | Camacho et al. | 220/912 |

* cited by examiner

*Primary Examiner* — Sang Y Paik

(57) ABSTRACT

A vessel incorporating an improved article support surface for supporting an article, such as a food product, during processing (e.g., baking, thawing, freezing), has a surface for supporting a food product or another article and a pattern is formed or otherwise incorporated in the article supporting surface. The pattern incorporated into the support surface is comprised of a set of points (pyramids) creating a high point and a low valley underneath the supported article or food product in which air circulates or flows during processing. In a preferred embodiment various shapes and sizes of baking sheets incorporating a "pyramid pattern" is stamped onto a metal sheet and the stamped metal sheet is then formed into the desired shape. The sheets are constructed of various metal alloys used in the food equipment industry including, but not limited to aluminum, carbon steel, stainless steel, copper, and silicone. The sheets will also be coated with a non stick substance.

2 Claims, 3 Drawing Sheets

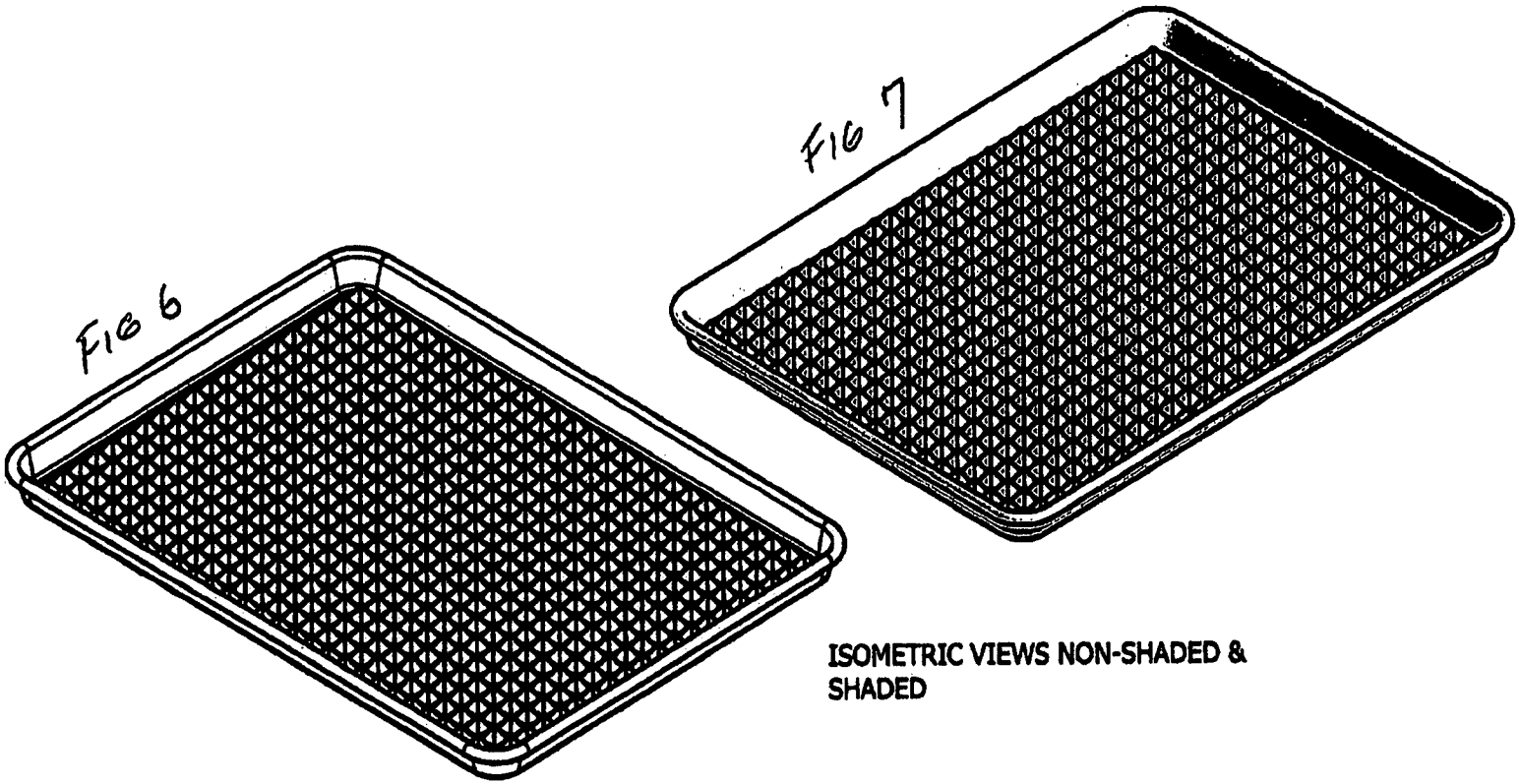
ISOMETRIC VIEWS NON-SHADED & SHADED

PYRAMID PAN

FIELD OF THE INVENTION

The present invention relates in general to vessels with improved supporting surfaces For supporting articles and pertains, more particularly, to a vessel for supporting food Products such as pre baked food during the baking process. The support surface is an Improvement over the traditional flat, bumpy or rippled surface found, for example On conventional baking sheets, cookie sheets, jelly roll pans, or pizza pans.

BACKGROUND OF THE INVENTION

With conventional vessels for supporting a food product or other article to be processed, the vessel includes a supporting surface that supports the article over substantially all of a supported surface of the article. For example, it is common to bake a breaded chicken breast on a flat cookie sheet or jelly roll pan.

These conventional baking pans are typically constructed of flat, bumpy, or rippled surface that provide for direct contact between breaded food. The direct contact between the food product, being baked and the pan result in a food product that is trapped or sealed or in complete contact with the baking surface of the pan.

The result of this "trapped" effect is well-know. The food product that is trapped on the cooking surface has a tendency to burn or stick, at least in part, to the direct heat transfer between the cooking surface that becomes essentially the same temperature as the baking appliance.

Another drawback of trapping the food product on the baking or cooking sheet or pan is the inability to effectively brown or crisp the food product with out having one side of the food product stick or burn.

It was previously mentioned that other surface treatments for cookie sheets, pizza pans, jelly roll pans and the like are known, and they include what has been referred to as bumpy surface or a rippled surface. It is believed that vessels constructed so as to have these or equivalent types of surfaces will suffer all of the drawbacks previously mentioned as well as additional related to cleaning the vessel after use, particularly after a use that results in a burned portion of the food product remaining on the cooking vessel.

These patterns, as well as the pyramid pattern discussed herein, are produced Commercially by stamping or forming. Generally this is done in a rolling mill or by an outside specialty metal manufacturer. Once to material has been rolled to the desired thickness, it is fed into a stamping device. This stamping device will have the same exact pattern which is then transferred to the metal cooking sheet. This same process can also be achieved by molding a silicone shape vessel into the same shape as mentioned in the above paragraphs.

SUMMARY OF THE INVENTION

Accordingly, it is an object of the present invention to provide a vessel for supporting an article having an improved support surface that is constructed with a pyramid pattern located on the support surface of the vessel. The pyramid pattern provides at least one air pocket between the vessel support surface and the article when the surface supports article so as to provide heat transfer between the article and the vessel.

Another object of the present invention is to provide a baking pan that is adapted to support a food product on a surface that does not trap the food product in direct contact, with the baking pan. With the baking pan of this invention foods can be browned or crisped in an oven with reduced occurrence of burning or sticking. A further object of the present invention is to provide a cooking vessel that includes a support surface that provides improved uniform cooking of food product. The cooking support surface of this invention with its air flow and circulation characteristics slows the heat transfer process while allowing fats to drip away from the food product during cooking.

Another object of the present invention is to provide a baking pan that is adapted to support a food product on a surface that does not trap the food product in direct contact with the baking pan. With the baking pan of this invention foods can be baked, or browned, or crisped in an oven that otherwise would not be capable of producing the desired results that the person cooking such an article would be looking for. Still another object of the present invention is to provide a cooking vessel that includes a support surface that allows excess fat and oils to drip away from the food article. Enhancing the desired overall browning, or crisping effect.

A further object of this invention is to provide an improved article support vessel that is adapted for its durability and ability to resist rust.

To accomplish the following and other objects of this invention there is a vessel incorporating an improved article support surface for supporting an article, such as a food product, during processing (e.g., baking, thawing, freezing). The vessel comprises a surface for supporting a food product or another article and a pyramid pattern formed or otherwise incorporated in the article supporting surface. The pattern incorporated into the support surface is comprised of a raised portion and a lower portion. The raised portion and the lower portion combine to define or create air pockets underneath the supported article of food product which allows air circulation as well as a way for excess fats and oils to drain away from the article or food product.

In the disclosed embodiments herein, there are provided various shapes of baking sheets incorporating a "pyramid pattern" as illustrated in the drawings. This preferred pattern is stamped on the metal sheet and the stamped metal sheet is then formed into the desired shape.

Also, in the preferred embodiment the sheets are constructed of various metal alloys or silicone materials used in the food equipment industry, including but not limited to aluminum, carbon steel, stainless steel, copper, glass or silicone.

These and other objects and features of the present invention will be better understood and appreciated from the following detailed description of preferred embodiments thereof, selected for purposes of illustration and shown in the accompanying drawings.

BRIEF DESCRIPTION OF DRAWINGS

FIG. 6 is a plan view showing isometric views of a baking pan of the present invention in a non shaded view.

FIG. 7 is a plan view showing isometric views of a baking pan of the present invention in a shaded view.

DETAILED DESCRIPTION(OF THE DRAWINGS)

Figure 1:
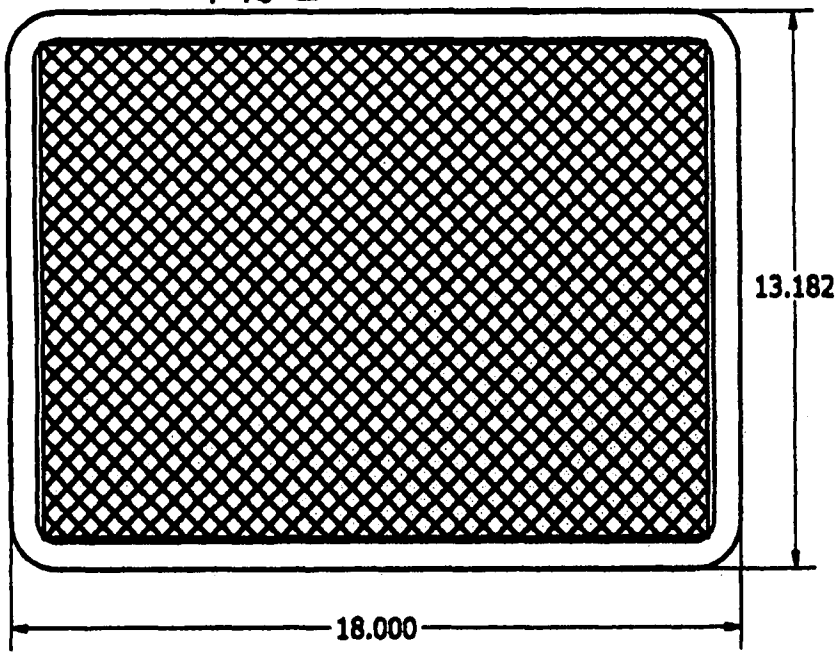
FIG. 1 is a perspective view of a baking pan constructed in accordance with the present invention.
Figure 2:
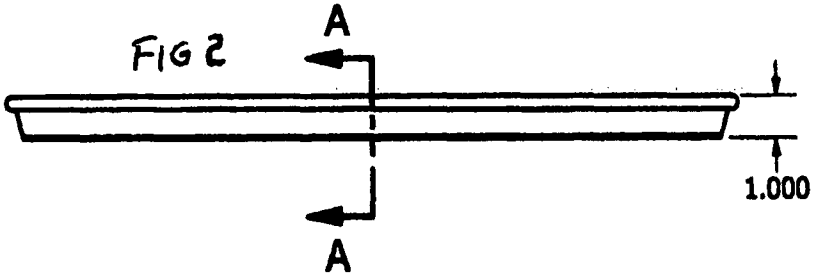
FIG. 2 is a perspective view of the baking pan of FIG. 1 constructed in accordance with the present invention.
Figure 3:
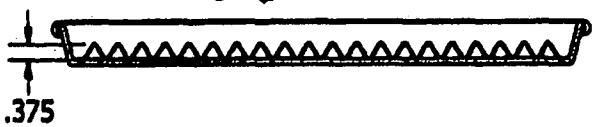
FIG. 3 is a cross section view along line A_A of FIG. 2 constructed in accordance with the present invention.
Figure 4:
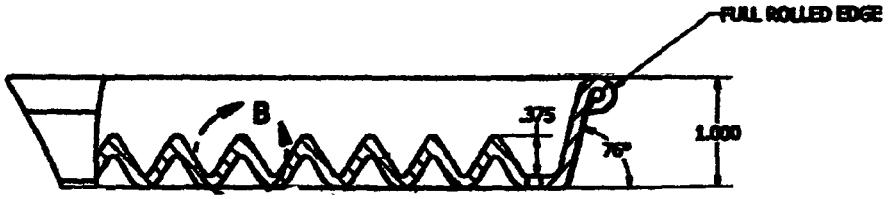
FIG. 4 is a plan view cross section of a patterned surface of the baking pan showing height of 0.375 inches to the top of the pyramid in accordance with the present invention.
Figure 5:
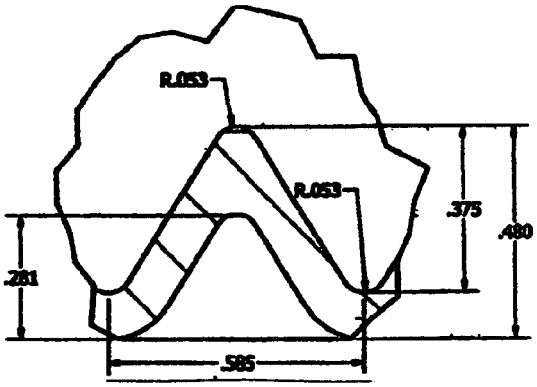
FIG. 5 is an enlarged view cross section of one single pyramid showing a lower radius of 0.053 inches and top radius of 0.053 inches with an overall height of 0.480 inches. Of reference of B in FIG. 4.

FIG. 1-7 are shown preferred embodiments for the improved support surface incorporated into a support vessel of this invention that is described in connection with a baking pan or cooking sheet to provide improved baking of a food product supported on the surface of the present invention. The support surface and the vessel incorporating the support surface of the present invention is particularly adapted for providing a combination of heat transfer and air flow as well as the ability to have excess oils and fats stay away from the article or food product and is characterized by pyramids provided by a stamped surface that increases the amount of the food product that is not in direct contact with the support vessel.

A preferred embodiment of the pattern used with the vessel illustrated in the drawings is referred to as a pyramid stamped surface. The pattern comprises of 560 (Five Hundred Sixty) pyramids at a height of 0.375 inches.

The metal sheets used to construct the vessels of the preferred embodiment are stamped with the pyramid pattern surface for baking and cooking various foods in an oven. The metal sheets are preferably an alloy common to the food equipment industry. The metal sheets will be coated in a non stick material.

Preferred embodiments of the presentation are constructed in a variety of shapes and sizes. The current choices are an approximately 13 inch by 18 inch rectangular sheet and an approximately an 8 inch by 10 inch rectangular sheet.

At the present time a rectangular pan is constructed in two sizes for the practical purpose of accommodating different styles and sizes of ovens. The current rectangular pans have rounded edges and protective corners.

While specific embodiments have been shown and described, many variations are possible. The particular shape of the vessel including weight and dimension may be changed as desired to suit the equipment with which it is used of the application for which it is used.

It will be understood that the use of the term pocket is not intended to be limited to a completely sealed volume between the food product and the surface of the vessel The term pocket generally refers to an open volume or void created in the patterned surface of the vessel by the combination of raised and low portions of the patterned surface.

The terms trapped or sealed as used herein is not intended to be limited to a airtight relationship between the food product and the supporting surface of the vessel and the air pocket. Rather, these terms refer to the generally abutting relationship that, results when food product is placed upon the patterned surface of the support surface of the vessel.

A patterned surface is within the scope of the present invention so long as the food product is supported in some fashion and complete surface to surface contact is not required by the present invention. In other words, contact exists between the patterned surface and the food product supported thereon.

The air pockets are defined as generally formed from a combination of a raised portion of the patterned surface and a low portion of the patterned surface. It should be understood that the use of the terms raised and low is relative.

Having described the invention in detail, those skilled in the art will appreciate that modifications may be made of the invention without departing from its spirit therefore it is not intended that the scope of the invention be limited to the specific embodiments illustrated and descried, rather, it is intended that the scope of this invention be determined by the appended claims and their equivalents.

The invention claimed is:

1. A cooking vessel for supporting a food product, comprising a sheet of silicone material having a pyramid patterned surface to support a food product during cooking, said pyramid patterned surface further comprising a plurality of multi-sided pyramid shapes arranged in a continuous manner, said multi-sided pyramid shapes including:

raised portions and lower portions defined by angularly disposed, slanted surfaces; said surfaces abut proximate pyramid shapes at the base of said lower portion and rise inwardly toward a point on said raised portion, so that a food item can be supported by a plurality of said multi-sided pyramid shapes by positioning it upon said points on said raised portion, and a height between the raised portion and the lower portion is substantially 0.375 inches.

2. The cooking vessel of claim 1, wherein said raised portions extend from said lower portions to form said points in a generally planar surface configuration, said planar surface configuration defining peaks and valleys that create pathways for air circulation and oil and fat removal.

* * * * *